United States Patent [19]

Cotte et al.

[11] 3,991,591

[45] *Nov. 16, 1976

[54] PATTERN DRUM FOR CIRCULAR KNITTING MACHINES

[75] Inventors: Dietrich Cotte, Karl-Marx-Stadt; Holger Scheffler, Lichtenstein; Claus Kertzscher, Zschopau, all of Germany

[73] Assignee: VEB Wirkmaschinenbau, Karl-Marx-Stadt, Germany

[ * ] Notice: The portion of the term of this patent subsequent to Oct. 14, 1992, has been disclaimed.

[22] Filed: July 7, 1975

[21] Appl. No.: 593,823

Related U.S. Application Data

[63] Continuation-in-part of Ser. No. 344,656, March 26, 1973, Pat. No. 3,911,697.

[52] U.S. Cl. ..... 66/50 B

[51] Int. Cl.[2] ..... D04B 15/74

[58] Field of Search ..... 66/50 B, 50 R, 154 R

[56] References Cited

UNITED STATES PATENTS

| | | | |
|---|---|---|---|
| 1,820,982 | 9/1931 | Lombardi | 66/50 B |
| 3,004,413 | 10/1961 | Felker | 66/50 B |
| 3,006,174 | 10/1961 | Haddad | 66/156 |
| 3,344,620 | 4/1965 | Saunders | 66/156 |
| 3,422,639 | 1/1969 | Saunders | 66/25 |
| 3,683,645 | 5/1970 | Audia | 66/50 A |
| 3,759,069 | 9/1973 | Scheffler et al. | 66/50 B |
| 3,911,697 | 10/1975 | Cotte et al. | 66/50 B |

FOREIGN PATENTS OR APPLICATIONS

| | | | |
|---|---|---|---|
| 956,989 | 4/1964 | United Kingdom | 66/154 |
| 874,719 | 8/1961 | United Kingdom | 66/25 |

*Primary Examiner*—Mervin Stein
*Assistant Examiner*—A. M. Falik
*Attorney, Agent, or Firm*—Nolte and Nolte

[57] ABSTRACT

A circular knitting machine in which the pattern drum has cams shiftable between operative and inoperative positions about a pivotal axis, the movement between the positions being less than 90° and there being locking means which is effective to secure the cams in one of the two positions. The selector members which are operated by the cams have associated with them means by which they may be disengaged from the cams.

2 Claims, 8 Drawing Figures

PATTERN DRUM FOR CIRCULAR KNITTING MACHINES

RELATED APPLICATION

This is a continuation-in-part of application Ser. No. 344,656, filed Mar. 26, 1973, now U.S. Pat. No. 3,911,697 issued Oct. 14, 1975.

BACKGROUND OF THE INVENTION

The invention concerns a pattern device for circular knitting machines, consisting of a stepping pattern drum, on whose circumference are arranged, evenly distributed in several planes, cams which are pivotally mounted on bolts extending parallel to the axle of the pattern drum for movement from an active into an inactive position and to which are assigned in each plane in the range of a switching position selector elements for transmitting the cam stroke to the stitch forming elements and related elements.

DESCRIPTION OF THE PRIOR ART

Known devices of this type have on the circumference of the pattern drum cams which can be turned by about 90° and which are arranged parallel to the axle of the pattern drum. These cams are held on the bolt by friction. In the active position the cams extend radially to the pattern drum and in the inactive position in the circumferential position of the pattern drum.

The inactive position of the cams is limited on one side by a stop. The disadvantage of this pattern drum is that the cams are not secured adequately either in the active or inactive position. The friction on the bolt is by no means sufficient and as a result of this pattern defects appear. Another disadvantage of this device is that such an arrangement of the cams, which can be turned by 90° cannot be used for small pattern drums with a great number of switching positions and consequently with little room per switching position.

In order to obtain the small space in the circumferential direction of the pattern drum for the adjustment of pattern cams, the latter have already been arranged for radial displacement in the pattern drum.

An axially removable rod was either in engagement with an outer or inner recess on the pattern cams and locked the latter both in the active and in the inactive position.

The disadvantage of this device is, however, that it was not possible to go with this pattern drum below a certain diameter, because a range for the guidance in two positions and a zone for the locking must be provided for the cams.

Another disadvantage of this device is that the adjustment of the cams is extremely time consuming, since each individual cam had to be pulled out by means of a hook or pincers or the like in order to bring it into a position in which the selection of a new pattern can be made.

Such a pattern drum is in addition very complicated and makes its use extremely uneconomical, particularly in circular knitting machines with a very great number of systems, both as far as the arrangement, the feeding of the pattern and the production are concerned.

SUMMARY OF THE INVENTION

The object of the invention is to design the pattern device so that it permits the mechanical or automatic feeding of the pattern without limiting the pattern possibilities with regard to circular knitting machines with a small number of systems and more space for one system.

The object of the invention is to provide a pattern device whose drum has cams which are pivotally mounted between an active and an inactive position in the circumferential direction of the pattern drum and which requires less space in the circumferential direction of the pattern drum per switching position, and where the cams can be locked positively both in the active and in the inactive position i.e., locked between fixed abutments rather than being locked by spring means or the like or by relying upon frictional engagement with a bolt.

The advantages of the solution according to the invention consist in that the drum could be substantially simplified in its design relative to the conventional program carriers.

The changing of patterns, that is, the adjustment of the cams in each switching position is possible from the outside both simultaneously and individually, depending on the pattern, by displacing stops or setting elements of a corresponding device in the circumferential direction of the drum.

The device for lifting out the selector elements does not result in an additional load on the cams, so that the safety of the pattern device is increased. The pattern device in this form is also suitable for circular knitting machines with a very low circumferential extension of each individual system.

BRIEF DESCRIPTION OF THE DRAWINGS

The invention will be described more fully on the basis of an embodiment. The respective drawings show in FIG. 1 a side elevation of the entire pattern device for a circular knitting machine.

DESCRIPTION OF THE PREFERRED EMBODIMENT

Figure 1:
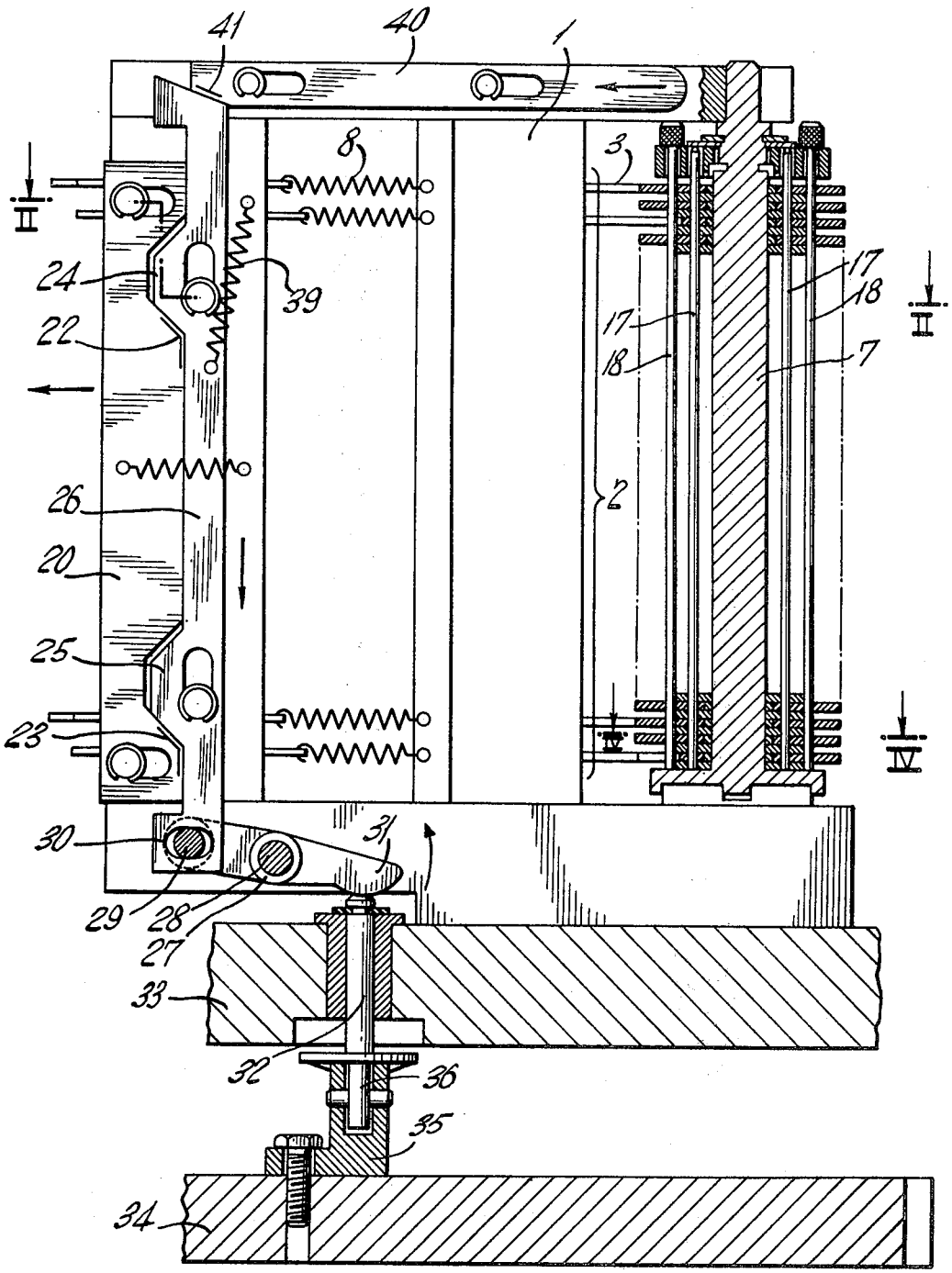
Figure 2:
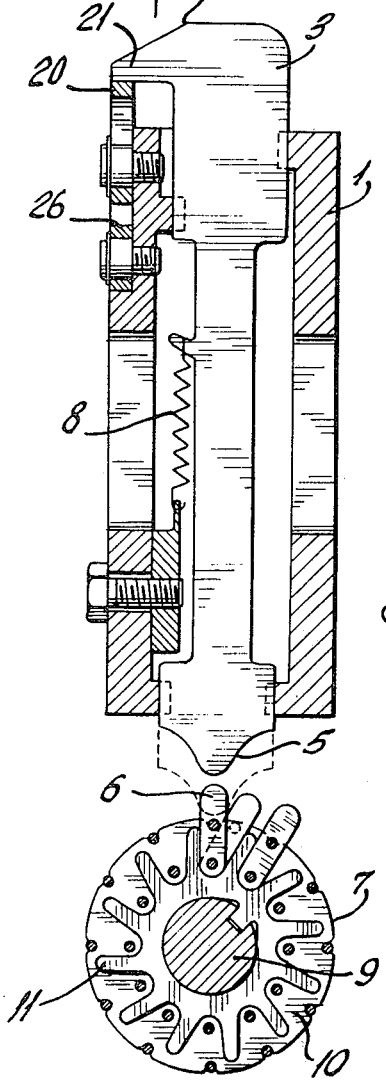
FIG. 2 a section on the line II—II of the pattern device according to FIG. 1 where all selector-elements are lifted from the pattern drum.
Figure 3:
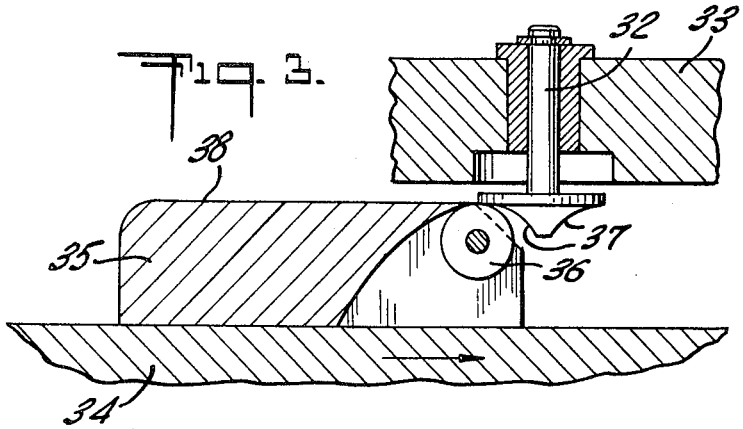
FIG. 3 shows a switching element for the lifting device.

As an example we selected a pattern device which is provided on large circular knitting machines and which effects there the election of the needles. The pattern device comprises cam controlled selector elements which cooperate with the pattern feet of jacks which in turn and conventionally, cooperate with the needle butts to effect the knitting operation.

The pattern device consists of stacks 2 of selector elements 3 guided in a frame 1. These selector elements 3 carry on their inner side a cam 4 which each act on a plane of the pattern selector butts (not shown). At their outer end the selector elements 3 are equipped with a lug 5 which is engaged selectively by the cams 6 of a pattern drum 7. The selector elements 3 are each held in the extreme position by a spring 8.

Figure 5:
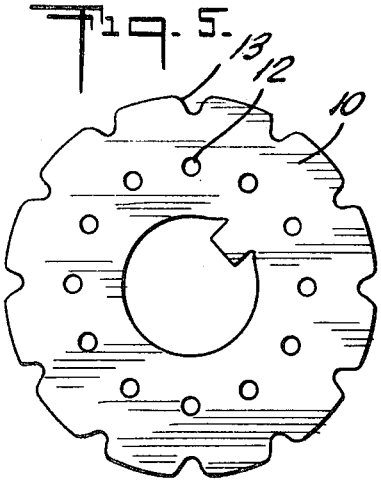
FIG. 5 shows a guide disk of the pattern drum.

The pattern drum 7 is stepped up from one switching position into the other by means of a drive (not shown). The pattern drum 7 consists of a plurality of disks 10, 11 on an axle 9. These disks 10, 11 are divided into two groups, one disk 10 of one group always alternating with a disk 11 of the other group. One group of the disks are guide disks 10, whose outside diameter corresponds to the diameter of the pattern drum 7 (FIG. 5). They have for each switching position a bore 12 in a distance from the outer surface of the guide disk. Radially outside the bore 12, a recess 13 is formed in the outer circumference of the guide disk 10.

Figure 6:
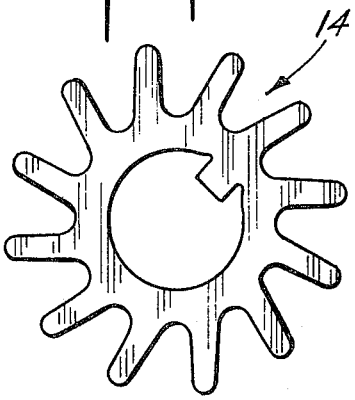
FIG. 6 shows a spacer.

The second group of the disks are the so-called spacer disks 11. They are arranged each between two guide disks 10 and have a substantially v-shaped recess 14 in the range of each switching position (FIG. 6).

Figure 7:
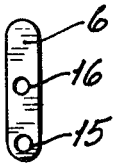
FIG. 7 shows a cam of the pattern drum.

When assembling the disks 10, 11 the cams 6 represented in FIG. 7, which have a bore 15 at one end and a second bore 16 substantially in the center (see FIG. 7), are inserted from the outside into the v-shaped recess 14 and held by a bolt 17 passing through the bores 12 of the guide disk 10 and the bores 15 of the cams 6. A rod 18 inserted, from the outside parallel to the axle 9 of the pattern drum 7, passes through the second bore 16 of the cam 6 and is held in the recess 13 of the guide disk 10. For selecting the patterns, the cams 6 which control the selector elements 3 are brought into the radial position and are held by rods 18 in that position.

Before insertion of bolt 18, the cams 6 which are not to act on selector elements 3 are turned about bolt 17 through an acute angle to an inoperative position in which they abut the right hand boundary of recesses 14. Upon insertion of bolt 18 through bore 16 of those cams in the operative or radial position, the cams in the inoperative position are held between the bolt 18 and the boundary of recess 14.

The selector elements 3, particularly their lugs 5 opposite the cam 6, are so designed that no pattern selection movement is caused by the swung-out, i.e., those not in the radial position, cams 6.

It is necessary to remove the selector elements 3 out of the range of the cams 6 during the stepping of the drum so that they are not contacted by those cams during that stepping operation.

This is effected by a device as represented in FIG. 1.

On the frame 1, which guides the selector elements 3, is mounted a rail 20 which is vertically immovable but which can be displaced parallel to itself in the direction of motion of the selector elements 3. The outside of this rail bears on the lugs or projections 21 of the selector elements 3. This rail 20 has two stops 22, 23, which are connected to two camming surfaces 24, 25 of a vertically displaceable strip 26.

The strip 26 is not displaceable horizontally. At the bottom end of the strip 26 is arranged a two-arm lever 27 whose fulcrum 28 is rotatably mounted on the frame 1 of the pattern device and whose left end 29 (FIG. 1) engages a recess 30 of the strip 26.

The right arm 31 of the lever 27 bears on a plunger 32 which is guided for vertical movement in the lock carrier plate 33. Below the lock carrier plate 33 is arranged the driving wheel 34 on which is secured the switching element 35 for the plunger 32. The switching element 35 consists of a cam whose rising leg is formed by a roller 36.

The bottom end of the plunger 32 is curved. The roller 36 strikes longitudinally against the cam 37 of the plunger 32 and pushes the latter upward so that the strip 26 is lowered and the rail 20 moves the selector elements 3 away from the pattern drum. It will of course be appreciated that the movement of strip 26 is effected by means of the cam and plunger arrangement and lever 31 from the drive of the needle cylinder or alternatively that movement is effected manually through lever 40. After the stroke is completed, the roller 36 places the plunger 32 on the upper surface 38 of the switching element 35 so that the plunger 32 remains in the top position. When the switching process of the pattern drum 7 is completed, the plunger 32 slides again off the surface 38, due to the pull of the spring 39 which keeps the strip 26 in its top position. The rail 20 returns to its original position and releases again the selector elements 3, so that their lugs rest either on the operative cams 6 of the pattern drum, i.e., the cams in the radial position or against the outside diameter of the pattern drum 7 as shown in chain line in FIG. 4. It is also possible to displace the selector elements 3 manually, to which end a slide or lever 40 is provided on the frame 1 which can displace the strip 26 downward over a cam 41 and thus move the rail 20 toward the needle cylinder.

The stepping mechanism is known and could be that, for example, illustrated in U.S. Pat. No. 3,759,069 issued July 31, 1973 to Ludwig et al. It is to be noted that the elements 35 and 36 of the present invention are connected non-rotatably with the rotating cylinder of the circular knitting machine as are the switching elements 17 through 20 of U.S. Pat. No. 3,759,069 and the elements are arranged on a common drive element. Referring now to the present invention, the roller 36 and the surface 38 of the switching element 35 causes the plunger 32 to be lifted before switching elements begin to act on the star wheel. The length of the surface 38 is so selected that the cam 37 of the plunger 32 slides off the latter only when the switching elements 17 and 19, respectively, have passed over the star wheel 12 of the U.S. patent aforementioned.

Figure 4A:
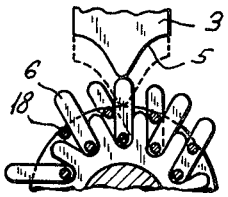
FIG. 4*a* is similar to FIG. 4 but for an alternative embodiment.
Figure 4:
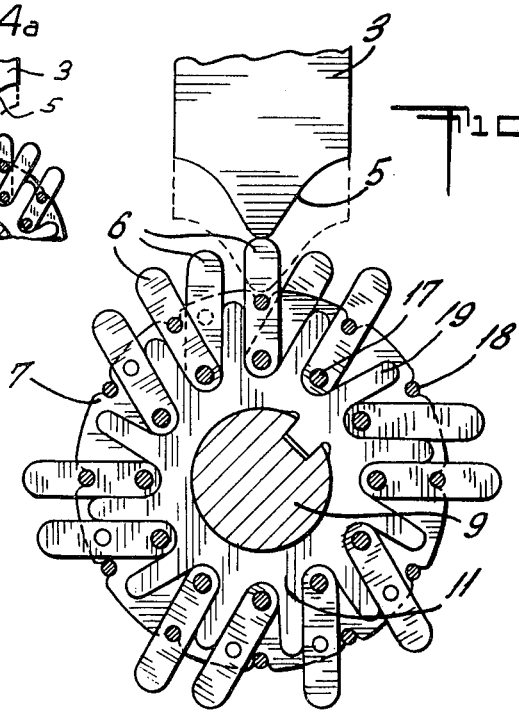
FIG. 4 shows the pattern drum in a section along the line IV—IV of FIG. 1.

Alternatively, rather than the rods 18 being positioned to pass through the cams 6 which are to be held in an operative position (FIG. 4), the rods 18 may be positioned to pass through the cams 6 which are to be in an inoperative position and the edge of those rods 18 abut other cams 6 in an operative position (FIG. 4*a*).

What is claimed is:

1. A circular knitting machine comprising a cylindrical pattern drum comprising disk means supporting a plurality of radially spaced cams each mounted for pivotal movement about an axis parallel to but offset from the drum axis, said cams being movable about their pivotal axes between a first and a second position, the angular movement between those positions being less than 90°, a plurality of said disk means arranged in a stack, a plurality of locking elements each associated with a plurality of radially aligned ones of said cams of said disk means and operable to secure the associated cams in selected ones of said positions, said cams cooperating with selector elements associated with stitch-forming means and means for disengaging the selectors from the cams, each of said locking elements passing through a cam to secure it in the said first position and holding others of the cams with which it is associated against a fixed abutment to secure it in the second position, said locking means being common to radially aligned ones of said cams in said stacks.

2. A circular knitting machine as claimed in claim 1 wherein said cams are supported at the periphery of said disks, said disks each defining a plurality of generally V-shaped recesses in corresponding ones of which said cams are located, radially aligned ones of said cams being mounted upon a pivot bolt common to said stacks, each cam having a hole therein disposed radially of said pivot bolt, a locking element comprising an axially extending rod to extend through said holes in said cams to secure the cams in a generally radial, operative position, which is the said first position, said rod being removable from said holes and said cams being pivotable about said pivot bolt to a non-operative position, which is the said second position, said rod and an adjacent portion of said recesses constituting means holding said cams in said non-operative position.

* * * * *